US010107304B2

(12) United States Patent
Tsai et al.

(10) Patent No.: US 10,107,304 B2
(45) Date of Patent: Oct. 23, 2018

(54) THIN FAN WITH AXIAL AIRGAP

(71) Applicant: COOLER MASTER CO., LTD., New Taipei (TW)

(72) Inventors: Shui-Fa Tsai, New Taipei (TW); Shih-Wei Huang, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 842 days.

(21) Appl. No.: 14/554,046

(22) Filed: Nov. 26, 2014

(65) Prior Publication Data

US 2015/0240835 A1 Aug. 27, 2015

(30) Foreign Application Priority Data

Feb. 27, 2014 (CN) ..... 2014 2 0086298 U

(51) Int. Cl.

| | |
|---|---|
| ***F04D 29/05*** | (2006.01) |
| ***F04D 25/16*** | (2006.01) |
| ***F04D 19/00*** | (2006.01) |
| ***F04D 29/52*** | (2006.01) |
| ***F04D 25/06*** | (2006.01) |

(Continued)

(52) U.S. Cl.

CPC ..... *F04D 29/52* (2013.01); *F04D 19/002* (2013.01); *F04D 25/0606* (2013.01); *F04D 25/0653* (2013.01); *F04D 25/166* (2013.01); *F04D 29/056* (2013.01); *F04D 29/0563* (2013.01); *F04D 29/424* (2013.01)

(58) Field of Classification Search

CPC .... F04D 29/52; F04D 19/002; F04D 25/0606; F04D 29/424; F04D 25/0653; F04D 25/166; F04D 25/0613; F04D 25/082; F04D 29/0561; F04D 29/056; F04D 29/0563; H02K 3/26; H02K 3/28

USPC ..... 417/423.1, 423.7, 424.2, 423.12; 310/156.32–156.37

See application file for complete search history.

(56) References Cited

U.S. PATENT DOCUMENTS 2,466,025 A * 4/1949 Hanson ..... F16N 7/00 277/513
3,840,761 A * 10/1974 Muller ..... H02K 29/08 310/156.37

(Continued)

FOREIGN PATENT DOCUMENTS

TW 201103234 A 1/2011

*Primary Examiner* — Essama Omgba
*Assistant Examiner* — Thomas Cash
(74) *Attorney, Agent, or Firm* — Muncy, Geissler, Olds & Lowe, P.C.

(57) ABSTRACT

A thin fan with an axial airgap includes a base having a bottom plate, a circuit unit, a stator set, and a rotor set. The stator set includes at least one winding part, plural induced magnets connected to the winding part, and at least one winding set wound on the winding part. The rotor set includes a hub, plural blades disposed around the hub, and a permanent magnet disposed around a bottom side of the hub and above the induced magnets. The winding set is outside of the permanent magnet. A pivot shaft is between the hub and the bottom plate and includes a bearing sleeve and a rotating shaft inserted in the bearing sleeve. The winding sets are moved outside of the permanent magnet, which reduces the heights occupied by the winding sets and the PCB, facilitating the thinning of the fan.

11 Claims, 9 Drawing Sheets

(51) Int. Cl.
*F04D 29/056* (2006.01)
*F04D 29/42* (2006.01)

(56) References Cited

U.S. PATENT DOCUMENTS 3,989,967 A * 11/1976 Kikuyama ..... G04C 13/11
310/112
4,164,690 A * 8/1979 Muller ..... F04D 25/0653
310/63
4,245,844 A * 1/1981 Pohl ..... F16C 32/06
277/432
4,336,471 A * 6/1982 Plancon ..... G04C 13/11
310/162
4,563,622 A * 1/1986 Deavers ..... H02K 29/08
310/156.12
4,861,237 A * 8/1989 Shiraki ..... F04D 25/0653
310/68 R
5,176,509 A * 1/1993 Schmider ..... H02K 5/1675
417/423.1
5,302,875 A * 4/1994 Taghezout ..... H02K 37/14
310/162
5,825,115 A * 10/1998 Kronenberg ..... G01R 7/06
310/216.025
6,158,967 A * 12/2000 Dupre ..... F04B 9/1372
277/300
7,525,228 B2 * 4/2009 Chuang ..... F04D 19/007
310/112
7,784,395 B2 * 8/2010 Tackett ..... F04B 15/04
277/926
9,551,348 B2 * 1/2017 Lin ..... F04D 17/16
2011/0298183 A1 * 12/2011 Lindner-Silwester .....
F04B 39/0022
277/500

* cited by examiner

THIN FAN WITH AXIAL AIRGAP

BACKGROUND OF THE INVENTION

Field of the Invention

The present invention relates to a fan and, in particular, to a thin fan with a structure of an axial airgap.

Description of Related Art

Induced motors are widely applied in various fields to provide power. For example, the heat-dissipated fan motor is commonly installed in electronic products such as desktop computers, notebook computers or tablet computers, which is used to dissipate the heat generated by electronic components.

As the design of electronic products has an increasing trend towards thinning, the thickness of the fan motor is required to be thinner. For the thinning of the fan motor, for example, a prior art of Taiwan Patent Publication No. TW201103234, entitled "A stator of a motor with a coil unit", discloses a motor structure with fine pattern coils (FP Coil), which deals with the problem of the excessive whole axial height resulted from the traditional motor stator having a structure of several silicon steel sheets stacked mutually. However, such a motor structure needs to combine the PCB (Printed Circuit Board) manufacturing process. As a result, the involved process and resultant structure are highly complex, causing high expense.

Therefore, following the trend towards thinning of the fan motor and simplifying the motor structure are the desired expectations in this technical field.

SUMMARY OF THE INVENTION

The objective of the present invention is to provide a thin fan with an axial airgap, which alters the stator arrangement to reduce the whole height to facilitate the thinning of the fan.

To achieve the above objective, according to an embodiment, the present invention provides a thin fan with an axial airgap. The thin fan comprises a base having a bottom plate and a sidewall disposed on the perimeter of the bottom plate; a circuit unit disposed on the bottom plate; a stator set comprising at least one winding part electrically connected to the circuit unit, a plurality of induced magnets connected to the at least one winding part, and at least one winding set correspondingly wound on the at least one winding part; and a rotor set. The rotor set comprises a hub, a plurality of blades disposed on a perimeter of the hub, and a permanent magnet disposed on a perimeter of a bottom side of the hub and correspondingly disposed above the induced magnets. A bearing opening is formed on the hub. The at least one winding set is located outside of the permanent magnet. A pivot shaft is disposed between the hub and the bottom plate; the pivot shaft comprises a bearing sleeve and a rotating shaft inserted in the bearing sleeve for relative rotation between the rotor set and the base.

The present invention has the beneficial effects as follows. The height occupied by the winding sets is reduced by moving the winding sets outside of the permanent magnet, which even reduces the height occupied by the PCB, facilitating the thinning of the fan.

To further understand the features and technical content of the present invention, please refer to the following description and accompanying figures. However, the accompanying figures are only used for reference and explanation, but not to limit the scope of the present invention.

DETAILED DESCRIPTION OF THE INVENTION

First Embodiment

Figure 1:
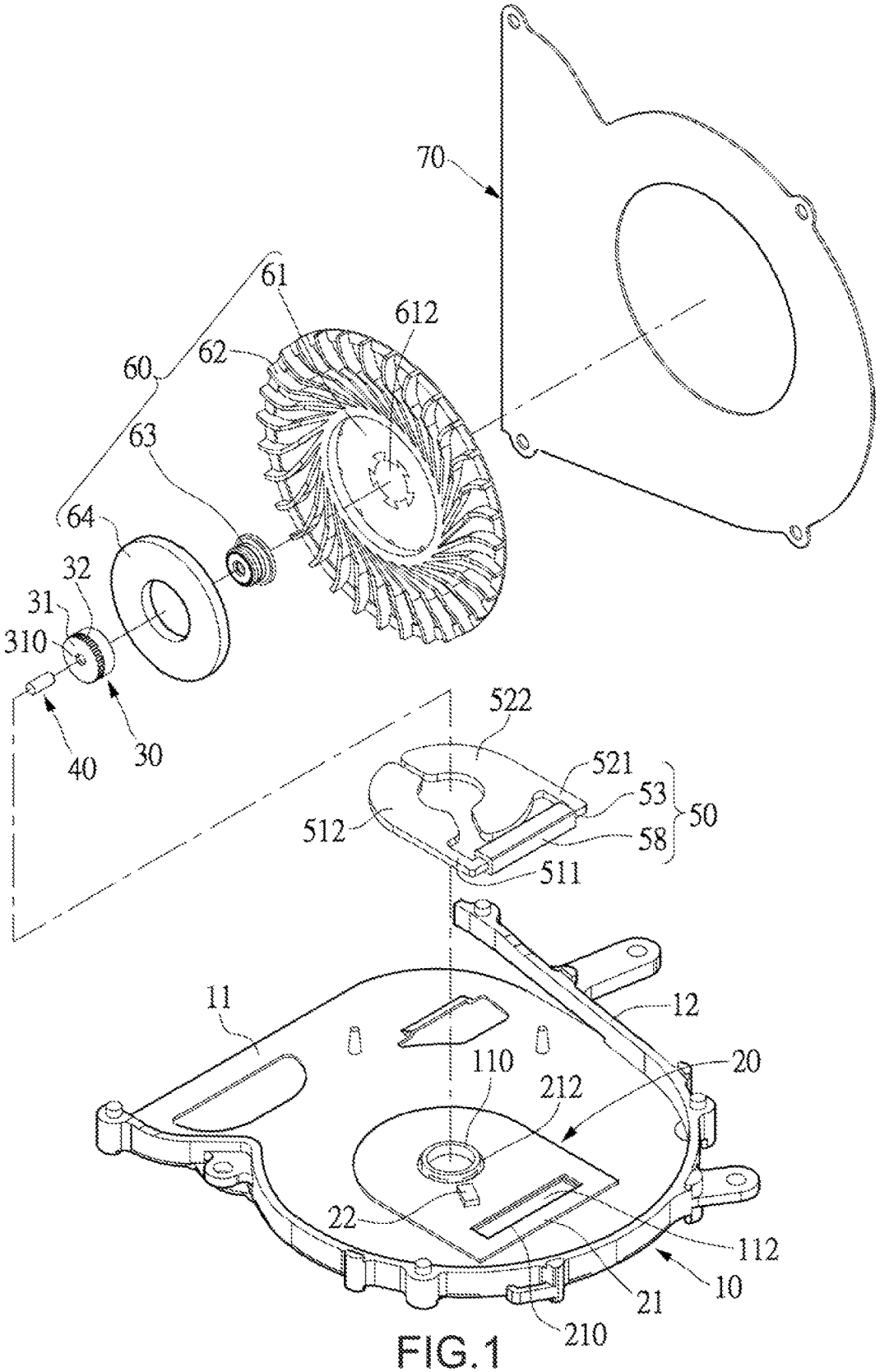
FIG. 1 is a perspective exploded view of the thin fan with an axial airgap of the present invention.
Figure 2:
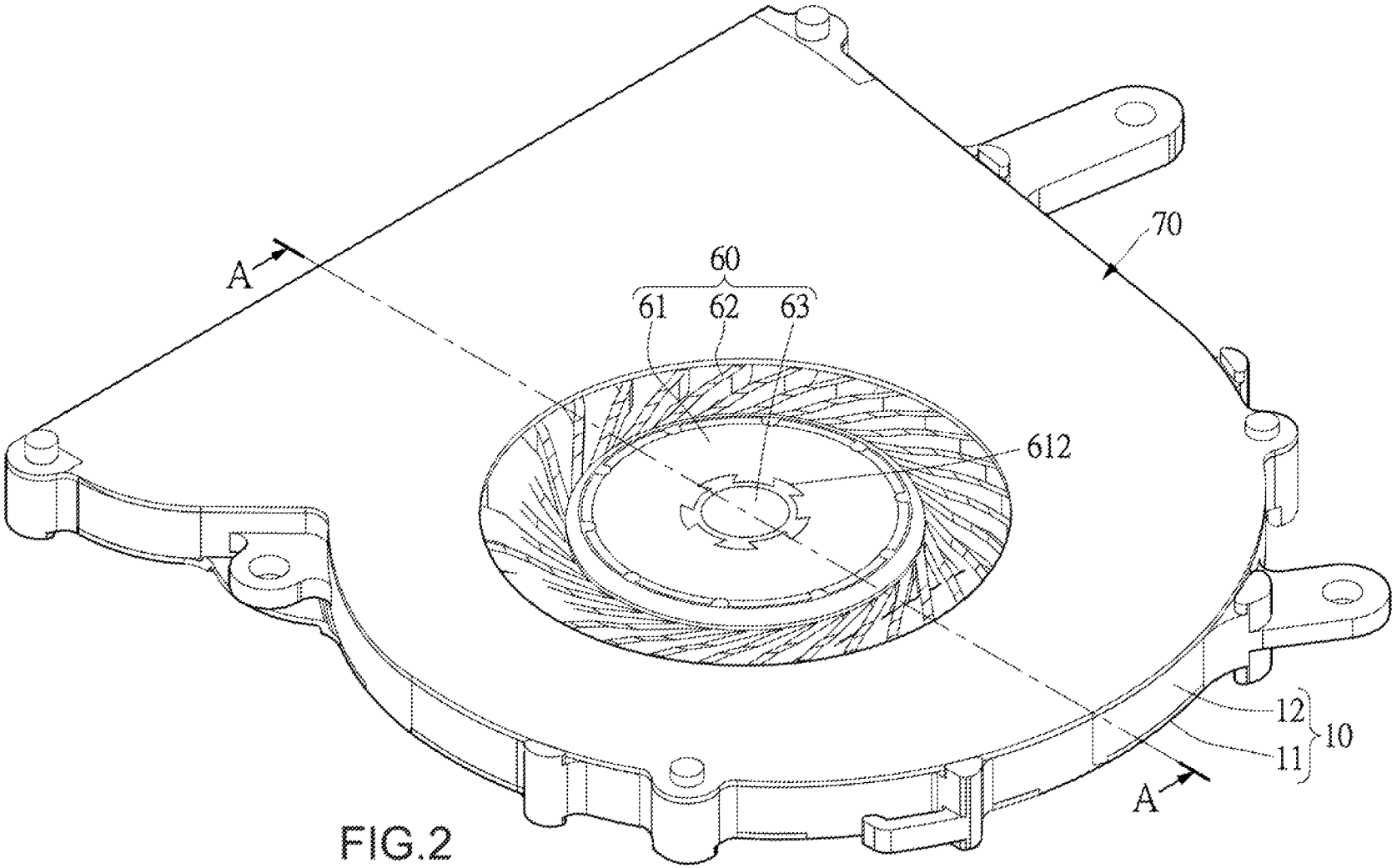
FIG. 2 is a perspective assembled view of FIG. 1.

Please refer to FIGS. 1 and 2, which are the perspective exploded view and the perspective assembled view of the thin fan with an axial airgap of the present invention, respectively. In the current embodiment of the thin fan with an axial airgap, a heat dissipation fan is taken as an example, but not limited to this. The design of the present invention can be applied in motors, water pumps, fans, and so on, and especially in the electronic components which needs to reduce the thickness thereof for thinning. The fan with an axial airgap comprises a base 10, a circuit unit 20, a sleeve seat 30, a rotating shaft 40, a stator set 50, a rotor set 60, and a cover plate 70.

The base 10 comprises a bottom plate 11 and a sidewall 12 disposed on a perimeter of the bottom plate 11. The cover plate 70 is disposed above and covers the base 10; the cover plate 70 is fixed on the sidewall 12. A sleeve opening 110 is formed on the bottom plate 11. In the current embodiment, the bottom plate 11 can be a metal plate or a plastic plate. The sidewall 12 is disposed on partial perimeter of the bottom plate 11 according to the design requirements.

The circuit unit 20 is disposed on the bottom plate 11. The circuit unit 20 comprises a printed circuit board (PCB) 21 and at least one electronic component 22 disposed on the PCB 21. In the current embodiment, a through hole 212 is formed on the center portion of the PCB 21 to fit with the sleeve seat 30 and corresponds to the sleeve opening 110 of the bottom plate 11.

The sleeve seat 30 comprises a sleeve bottom 31 and a sleeve side portion 32 connected to a perimeter of the sleeve bottom 31. The sleeve bottom 31 is fixed to the sleeve opening 110 of the base 10. A welding hole 310 is formed on the center portion of the sleeve bottom 31. In the current embodiment, the sleeve seat 30 is preferably a metal seat. The sleeve seat 30 can be snapped into the sleeve opening 110 of the bottom plate 11. Alternatively, the sleeve seat 30 can be fixed to the sleeve opening 110 of the bottom plate 11 by means of plastic injection.

The rotating shaft 40 is vertically fixed on the bottom plate 11. Only the bottom end of the rotating shaft 40 fixed on the bottom plate 11 is also acceptable. In the current embodiment, the rotating shaft 40 is first fixed to the sleeve seat 30 in which the rotating shaft 40 is fixed to the center of the sleeve bottom 31. The bottom end of the rotating shaft 40 can be fixed to the welding hole 310 of the sleeve seat 30 by means of welding; thus, the thickness of the fan can be reduced. The welding method is preferably performed by laser welding to replace the traditional dispensing-and-riveting method or the method of wrapping by injection. However, the fixing methods are not limited to the above ones in the present invention. For example, a welding hole can be formed on the center portion of the bottom plate 11 and then the bottom end of the rotating shaft 40 is welded to the welding hole.

The feature of the present invention is to alter the structure of the stator set 50; that is, the welding set is moved outwards to reduce the height occupied by the whole structure. In the current embodiment, the stator set 50 has a winding part 53 having a straight shape, and a winding set 58 wound on the winding part 53. Each of two ends of the winding part 53 is connected to a connecting arm 511, 521. Each of the connecting arms 511, 521 connects the corresponding induced magnets 512, 522 which are arranged in a circle, but not limited to this. The winding part 53, the connecting arms 511, 521, and the induced magnets 512, 522 can be integrated and called a metal frame. The metal frame can be made of mutually stacked silicon steel sheets or integrated molded magnetic metal powder. The winding set 58 is mainly composed of an insulated carrying seat and coils (both not shown).

In the current embodiment, the stator set 50 is located on the PCB 21 of the circuit unit 20. To further reduce the height of the fan, a winding set hole 210 is formed on the PCB 21 of the circuit unit 20 to receive part of the winding set 58. Besides, an opening 112 can be formed on the bottom plate 11 of the base 10 corresponding to the winding set hole 210 in which the winding set 58 is partially disposed in the opening 112.

The rotor set 60 comprises a hub 61, a plurality of blades 62 disposed on a perimeter of the hub 61, a bearing sleeve 63, and a permanent magnet 64 disposed on a perimeter of a bottom side of the hub 61. A bearing opening 612 is formed on the hub 61; the bearing sleeve 63 is fixed to the bearing opening 612. The rotating shaft 40 is inserted in the bearing sleeve 63. The permanent magnet 64 has an annulus shape and is disposed correspondingly above the induced magnets 512, 522 such that an axial airgap is formed between the permanent magnet 64 and the induced magnets 512, 522. The winding set 58 is located outside of the permanent magnet 64. The induced magnetic field generated by an applied current is distributed throughout the arced-shaped induced magnets 512, 522, which interacts with the axial permanent magnet 64 to produce an attractive force or a repelling force to rotate the blades 62. In the current embodiment, the induced magnets 512, 522 can shield the magnetic field of the permanent magnet 64 to prevent other components of the electronic device from being affected.

Figure 3:
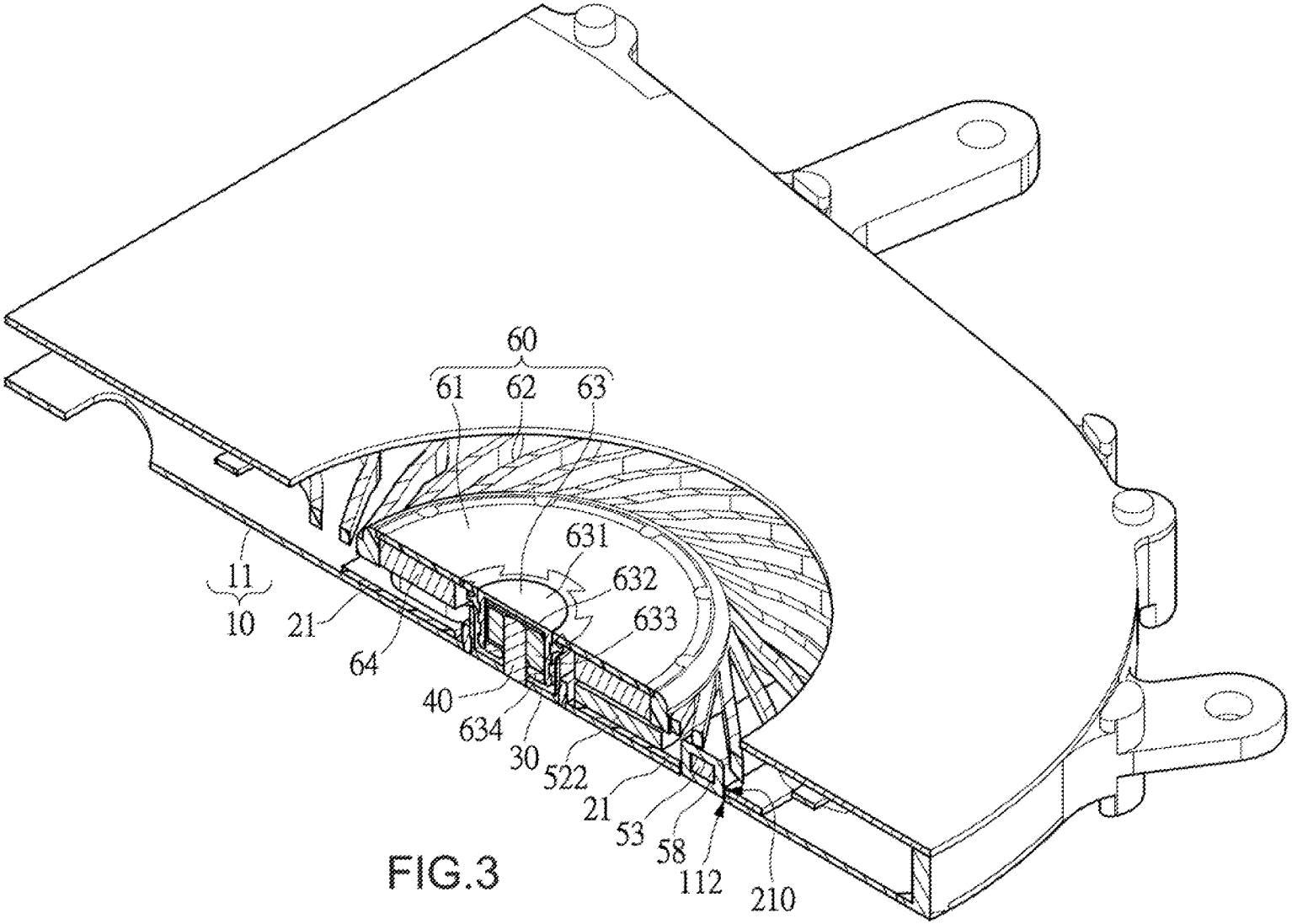
FIG. 3 is a perspective cross-sectional view form line A-A of FIG. 2.
Figure 4:
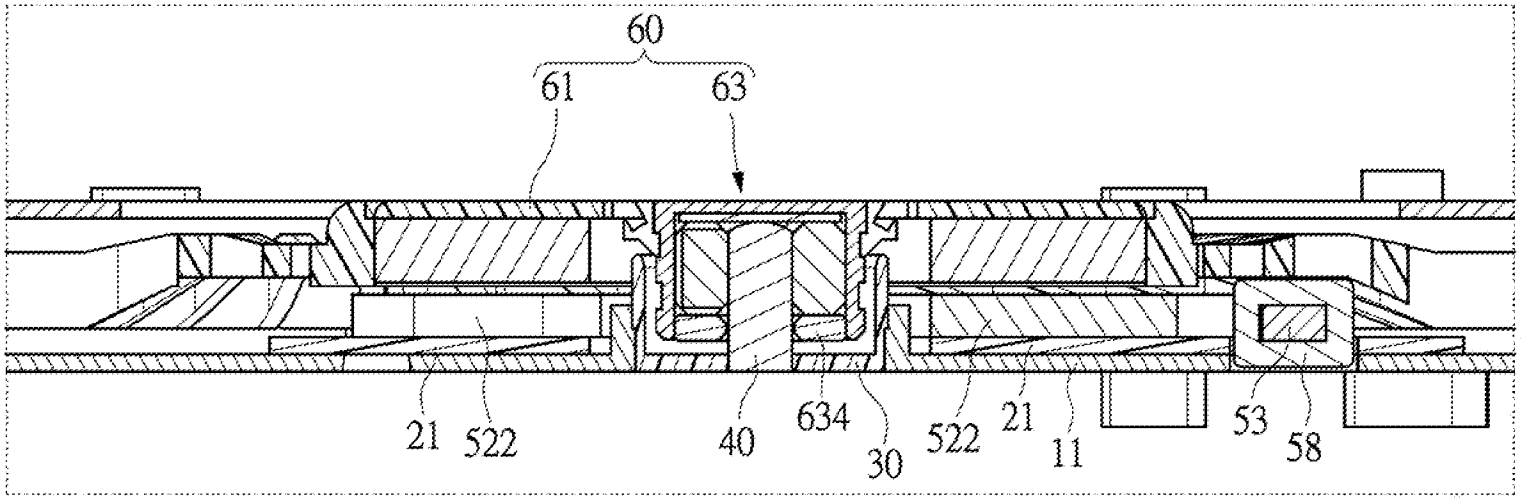
FIG. 4 is a local cross-sectional view from line A-A of FIG. 2.

FIG. 2 shows a perspective assembled view of the present invention. Please refer to FIGS. 3 and 4, which are the perspective cross-sectional view and the cross-sectional view from line A-A of FIG. 2, respectively. The above-mentioned bearing sleeve 63 comprises a shaft tube 631, a washer 632 disposed an inner top side of the shaft tube 631, a bearing 633, and a seal cover 634. The bottom end of the rotating shaft 40 is welded to the sleeve seat 30 which is fixed to the sleeve opening 110 of the bottom plate 11; the top end of the rotating shaft 40 presses against and connects the washer 632 of the bearing sleeve 63. Such a arrangement is called the axially inverted structure. The whole height of the fan is equal to the summation of the height of the rotating shaft 40, the thickness of the washer 632, and the top wall of the shaft tube 631. Thus, the current embodiment enables the thinning of the fan.

Moreover, an axially inverted fan motor is used to explain the current embodiment. However, the present invention is not limited to the axially inverted type. The rotating shaft 40 can be regularly disposed in which the top end of the rotating shaft 40 is fixed to the center of the hub 61, the bearing sleeve 63 is reversely disposed on the bottom plate 11, and the bottom end of the rotating shaft 40 is inserted in the bearing sleeve 63. In this way, the rotor set can rotate with respect to the base. The above rotating shaft and the bearing sleeve can be called the pivot shaft. That is, the present invention can regularly or reversely dispose the pivot shaft between the hub 61 and the bottom plate 11 for the rotation between the rotor set and the base.

Figure 5:
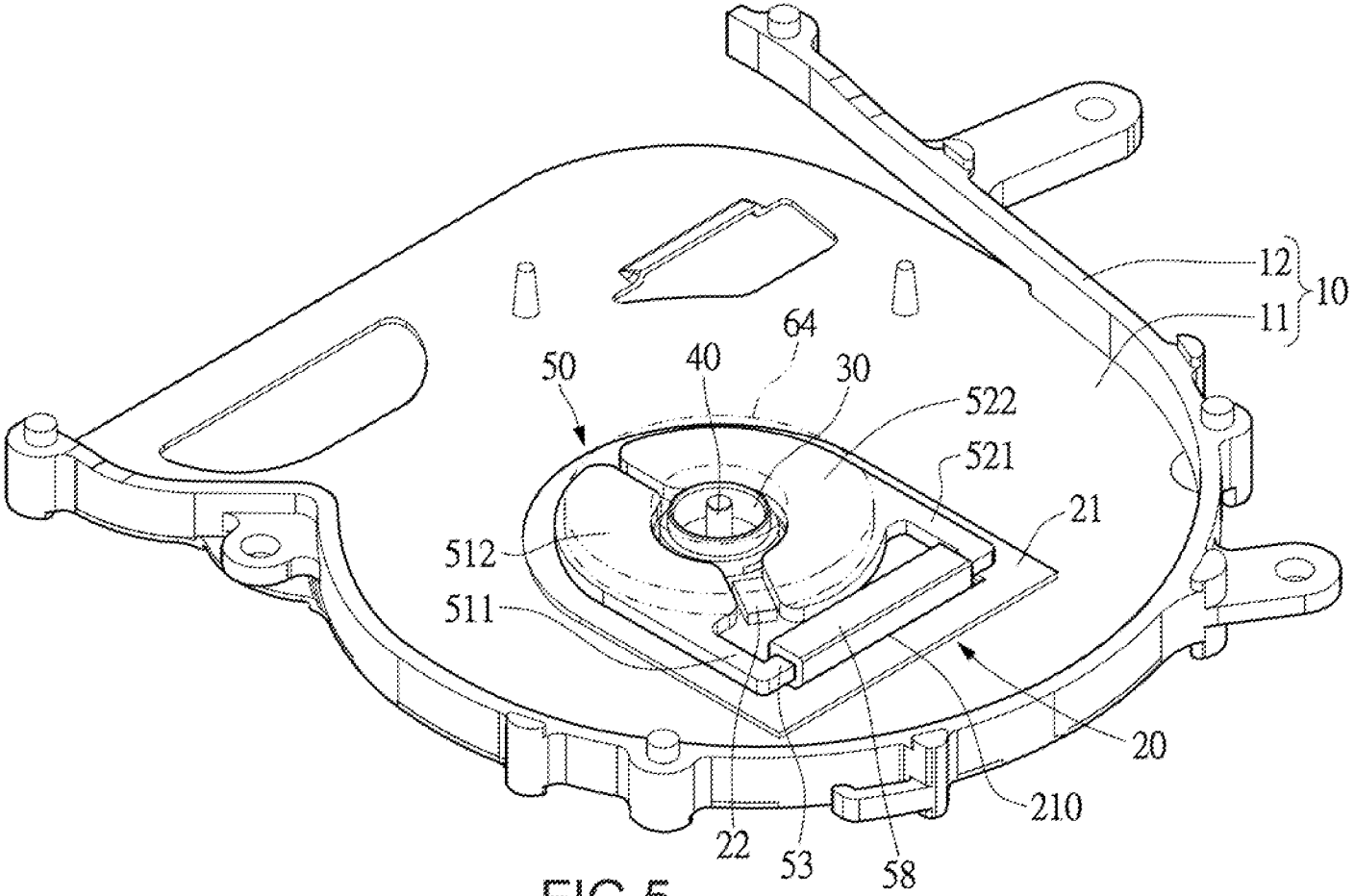
FIG. 5 is a schematic view of FIG. 2 with the rotor set and the cover plate removed.

Please refer to FIG. 5, which is a schematic view of FIG. 2 with the rotor set 60 and the cover plate 70 removed. The stator set 50 in the current embodiment can be regarded as a single phase two-slot two-pole stator set. The electronic component 22 of the circuit unit 20 can be disposed in a slot between the induced magnets 512, 522. The electronic component 22 may comprise a control component to control magnetic change of the induced magnets 512, 522 and a sensing component to sense the above permanent magnet 64, such as a hall element. In the current embodiment, compared with the traditional structure composed of the star-shaped silicon steel sheets and the winding set, the winding set 58 is moved outside of the permanent magnet 64, which reduces the height occupied by the winding set and only the heights of the induced magnets, permanent magnets, and the gap in between are left; thus, the thinning of the fan can be achieved by the present invention.

To fix the metal frame (including the winding part 53, the connecting arms 511, 521, and the induced magnets 512, 522) of the stator set 50 and the winding set 58 to the bottom plate 11, the fixing method can be done by riveting, fitting, welding, or screwing, if the bottom plate 11 is made of metal. The fixing method can be thermal melting, or insert molding, if the bottom plate 11 is made of plastic.

However, the stator set of the present invention is not limited to that in the above embodiment. For example, it can be implemented by two above-mentioned stator sets disposed opposite to each other with a four-slot four-pole arrangement, or by a three-phase arrangement with a three-slot two-pole, three-slot four-pole, six-slot four-pole, or six-slot eight-pole arrangement. In short, the stator set can comprise at least one winding part electrically connected to the circuit unit, a plurality of induced magnets connected to the at least one winding part, and at least one winding set correspondingly wound on the at least one winding part. The induced magnets surround the perimeter of the rotating shaft. The stator sets according to different embodiments of the present invention will be given as follows.

Second Embodiment

Figure 6:
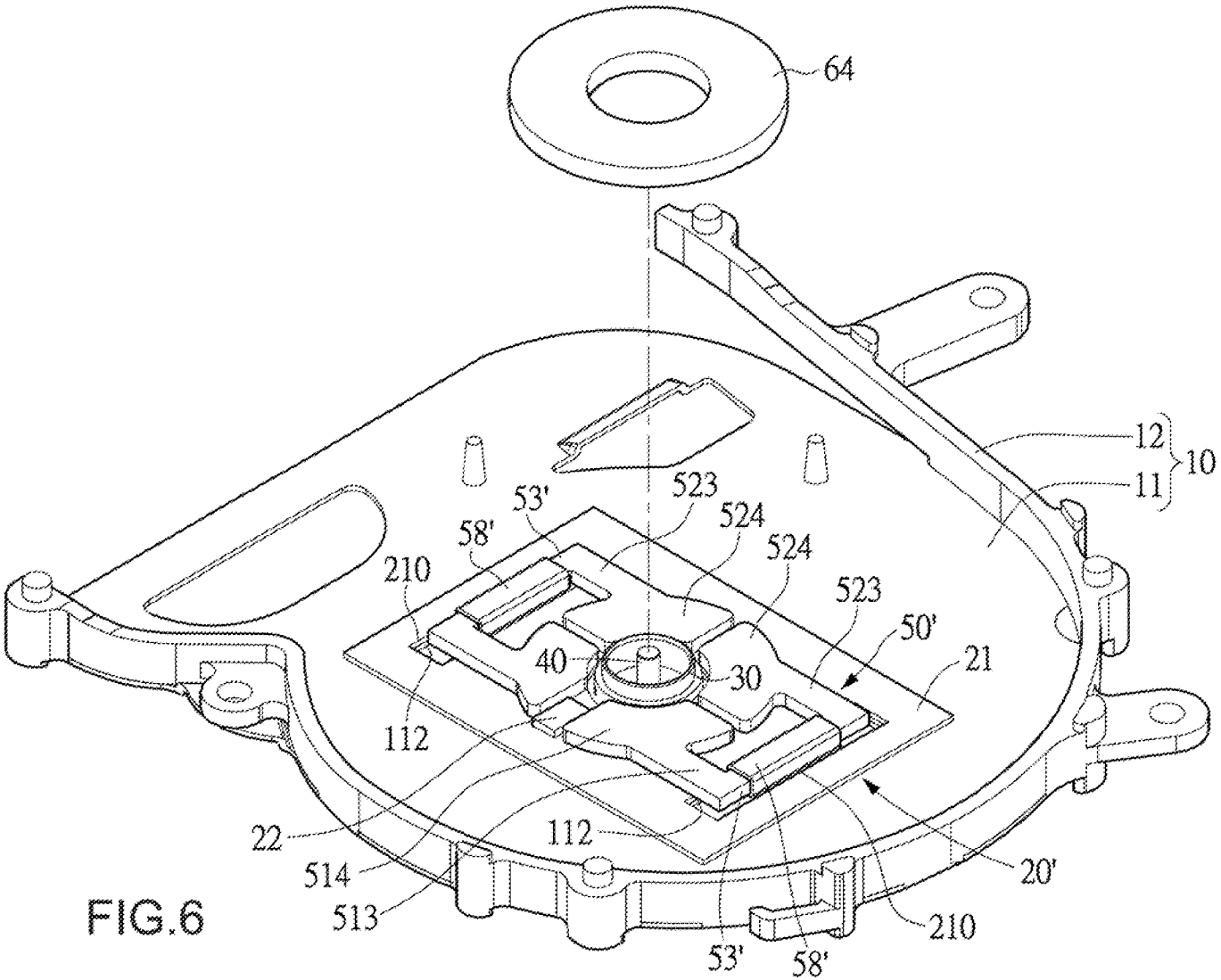
FIG. 6 is a schematic view of the fan according to the second embodiment of the present invention with the rotor set and the cover plate removed.

Please refer to FIG. 6, which is a schematic view of the fan according to the second embodiment of the present invention with the rotor set and the cover plate removed. In the current embodiment, the rotor set and the cover plate are the same as those in the first embodiment and will not be explained below. The stator set 50' is composed of two symmetric silicon steel sheets and two winding sets 58', which forms a four-slot four-pole arrangement. The stator set 50' has two winding parts 53' which are disposed opposite to each other and have straight shapes. Each of the two winding parts 53' is wound by the winding set 58'. Two ends of each of the two winding parts 53' are individually connected to a connecting arm 513, 523 which connects the corresponding induced magnets 514, 524 arranged in a circle.

The circuit unit 20' in the present invention comprises a PCB 21 and at least one electronic component 22 disposed on the PCB 21. The stator set 50' is located on the PCB 21 of the circuit unit 20'. Two winding set holes 210 are formed on the PCB 21 to correspondingly receive the two winding sets 58'.

Third Embodiment

Figure 7:
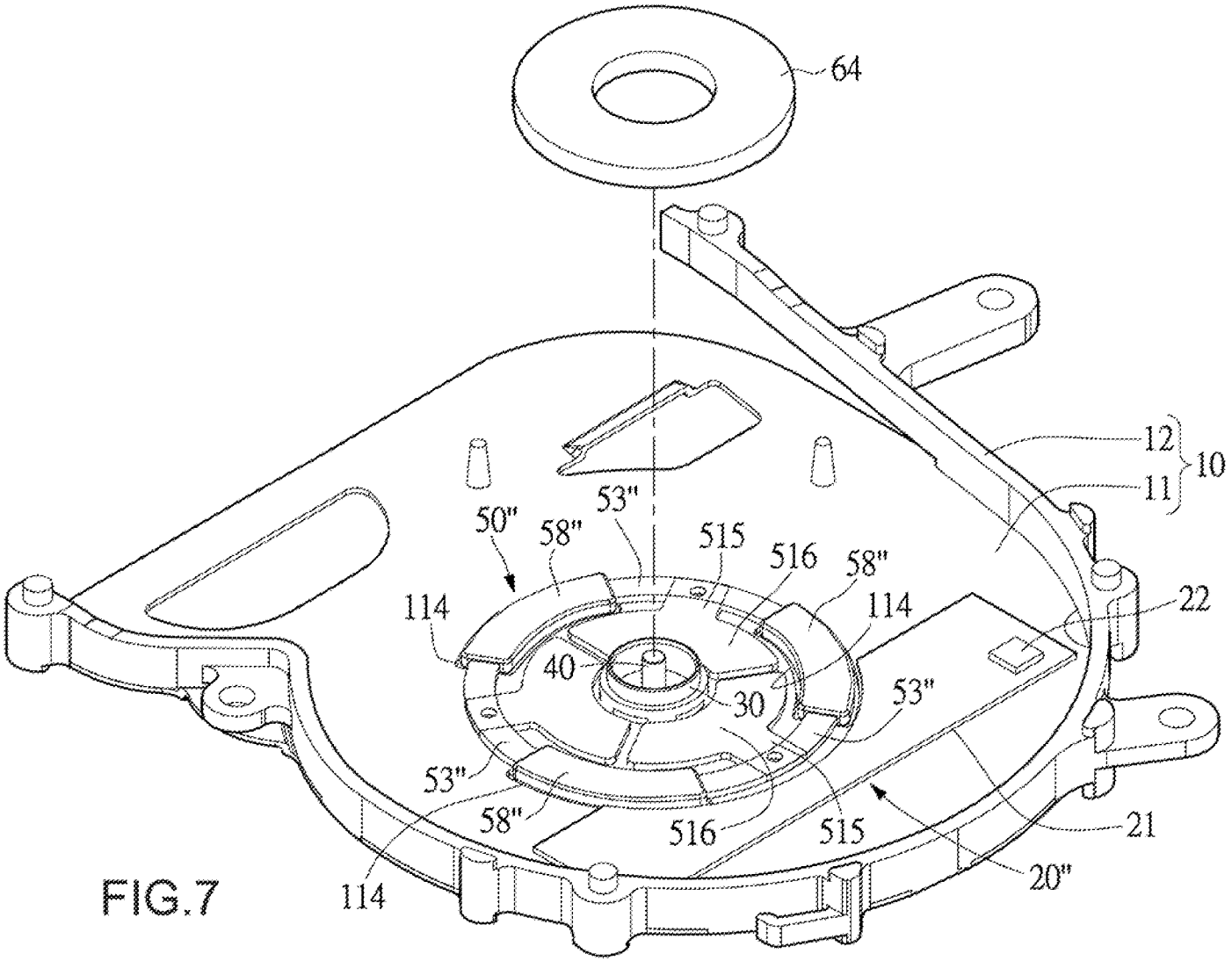
FIG. 7 is a schematic view of the fan according to the third embodiment of the present invention with the rotor set and the cover plate removed.

Please refer to FIG. 7, which is a schematic view of the fan according to the third embodiment of the present invention with the rotor set and the cover plate removed. In the current embodiment, the rotor set and the cover plate are the same as those in the first embodiment and will not be explained below. The stator set 50" is composed of three symmetric silicon steel sheets and three winding sets 58", which forms a three-phase three-slot two-pole arrangement. The stator set 50" is roughly divided into an outer ring and an inner ring. In the current embodiment, the winding sets 58" are disposed around the outer ring and the induced magnets 516 are disposed around the inner ring.

The stator set 50" has three winding parts 53" which are disposed in a circle. Each of the three winding parts 53" is wound by the winding set 58". A connecting arm 515 extends inwards from between each two adjacent winding parts 53" and connects the corresponding induced magnets 516 arranged in a circle. That is, each of the induced magnets 516 forms an arc of 120 degrees.

In the current embodiment, the circuit unit 20" which is disposed outside of the stator set 50" comprises a PCB 21 and at least one electronic component 22 disposed on the PCB 21. Compared with the above two embodiments, the current embodiment can reduce the height occupied by the PCB 21, further reducing the height of the fan.

The above-mentioned the winding sets 58" are disposed around the outer ring, but not limited to this. For example, the winding sets 58" can be disposed on the above-mentioned connecting arms 515. The connection between the outer ring of the winding sets 58" and the inner ring of the induced magnets 516 can be done by riveting, fitting, welding, or screwing.

According to the current embodiment, variants can be further obtained. For example, three winding sets can be disposed around the outer ring and six connecting arms can extend inwards from the outer ring. Each of the winding sets corresponds to two connecting arms; each of the connecting arms connects an induced magnet 516 having an arced shape. Six induced magnets 516 in total are arranged to form the inner ring.

Fourth Embodiment

Figure 8:
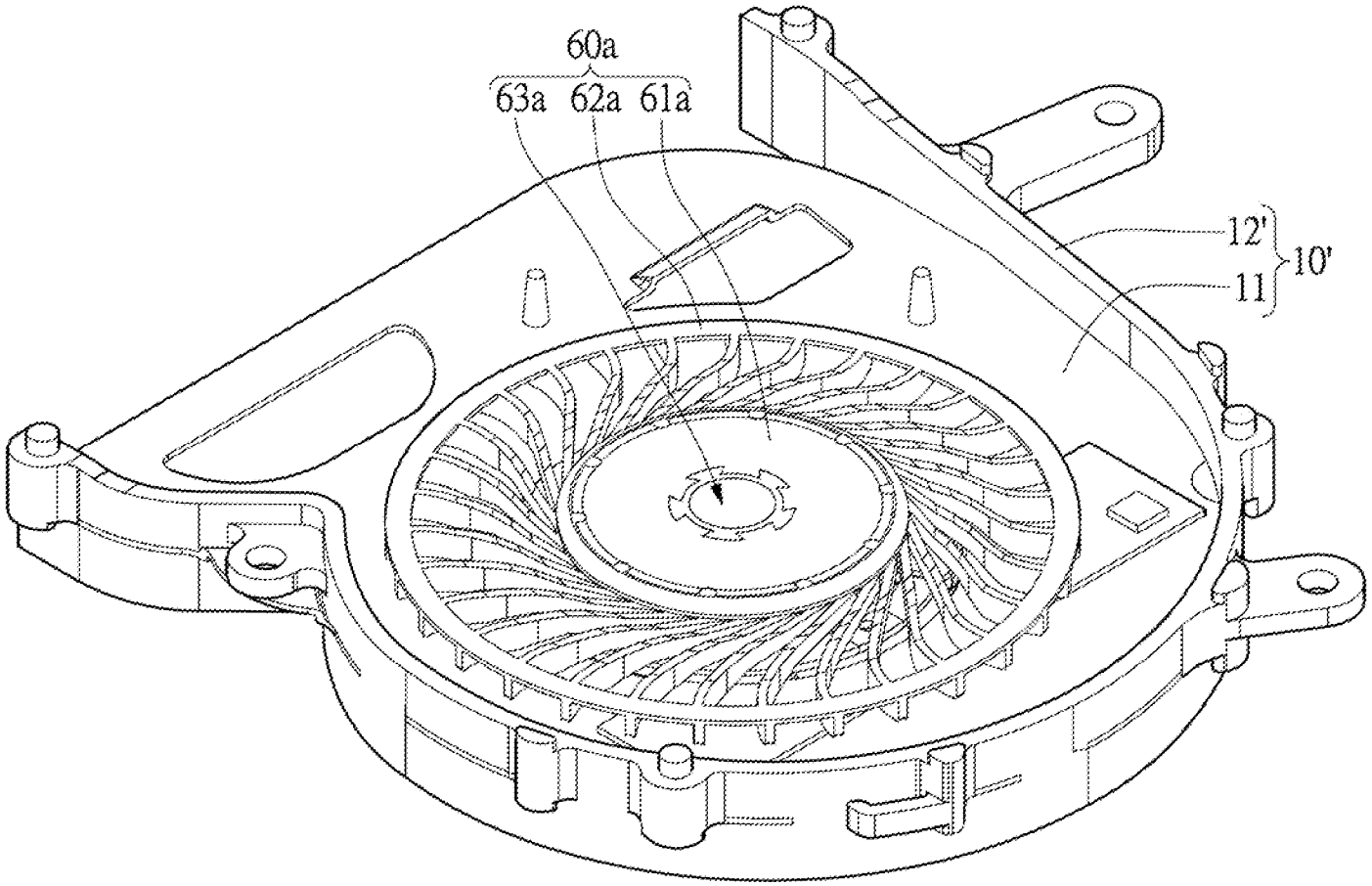
FIG. 8 is a perspective view of the fan with an axial airgap and a two-fan structure of the present invention.
Figure 9:
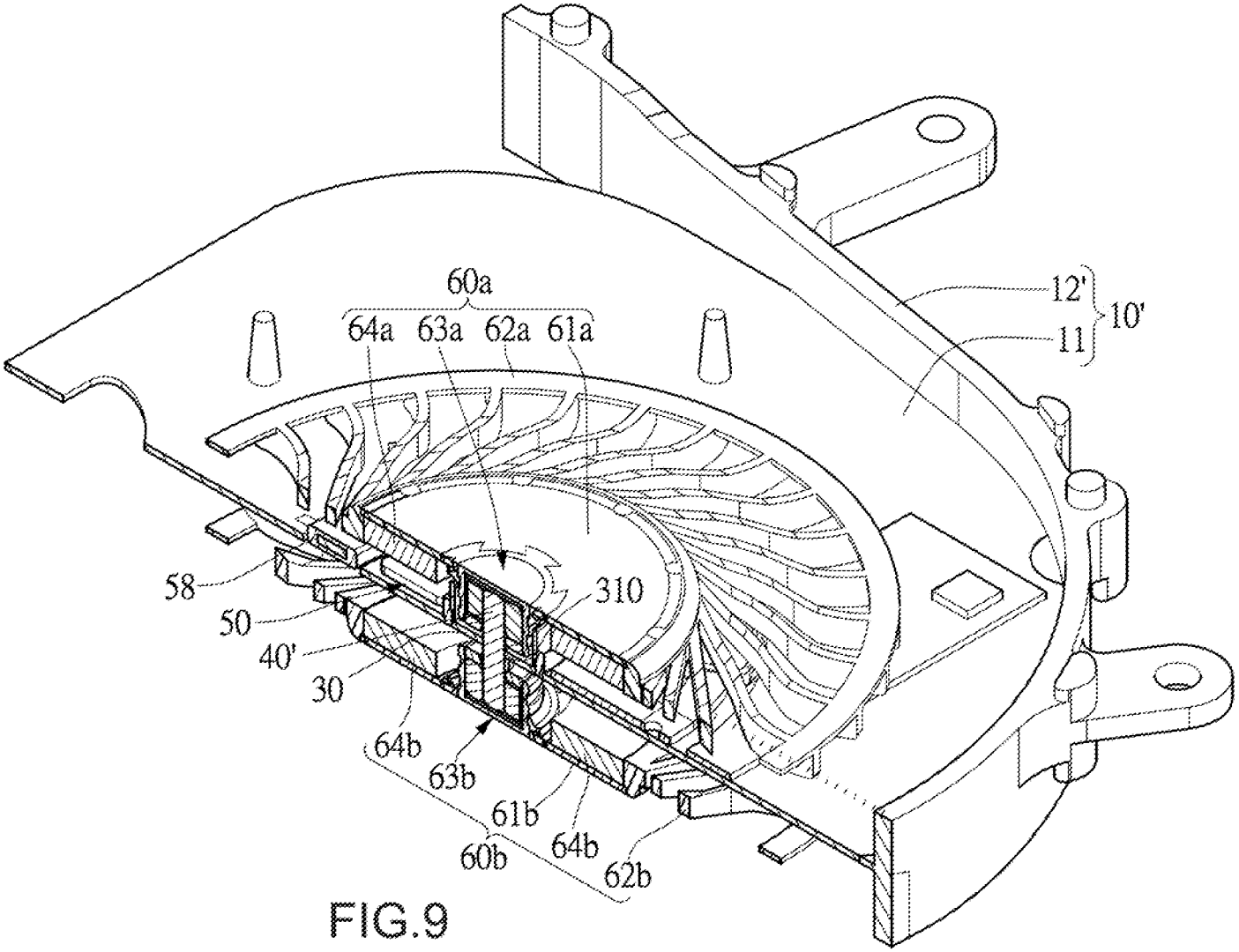
FIG. 9 is a cross-sectional view of the fan with an axial airgap and a two-fan structure of the present invention.

Please refer to FIGS. 8 and 9, which are the perspective view and the cross-sectional view of the fan with an axial airgap and a two-fan structure of the present invention, respectively. The base 10' of the fan with an axial airgap in the current embodiment comprises a bottom plate 11 and a sidewall 12' disposed on the bottom plate 11. The height of the sidewall 12' is twice as that of the sidewall 12 of the previous embodiments. A sleeve seat 30 is fixed to the bottom plate 11; a rotating shaft 40' is fixed to the sleeve seat 30 and extends towards two sides of the bottom plate 11. The difference between the current embodiment and the previous embodiments is that two rotor sets are individually disposed on the upper side and the lower side of the bottom plate 11, as shown in FIG. 9, to increase the wind flow. For easy identification, the two rotor sets are named as the first rotor set 60*a* and the second rotor set 60*b*.

The first rotor set 60*a* and the second rotor set 60*b* have the same structure and are sleeved around the same rotating shaft 40' at each end thereof. Besides, The first rotor set 60*a* and the second rotor set 60*b* are both driven by the rotor set 50. In the current embodiment, the rotor set 50 is disposed on the upper side of the bottom plate 11 which can be applied in the rotor set of the previous embodiments. The rotating shaft 40' can be regarded as the rotating shaft in the previous embodiments further extending towards the side of the bottom plate 11. The first rotor set 60*a* is disposed above the rotor set 50; the second rotor set 60*b* is disposed below the rotor set 50. Both the first and the second rotor sets 60*a*, 60*b* are driven by the rotor set 50. The bottom plate 11 is made of any material which allows the magnetic field to penetrate.

As shown in FIG. 9, the first rotor set 60*a* which is disposed on the upper side of the bottom plate 11 has a structure similar to that in the previous embodiments and comprises a first hub 61*a*, a plurality of first blades 62*a* disposed on a perimeter of the first hub 61*a*, a first bearing sleeve 63*a* fixed to the center of the first hub 61*a*, and a first permanent magnet 64*a* fixed to the first hub 61*a*. The second rotor set 60*b* which is disposed on the lower side of the bottom plate 11 has a structure similar to first rotor set 60*a* and comprises a second hub 61*b*, a plurality of second blades 62*b* disposed on a perimeter of the second hub 61*b*, a second bearing sleeve 63*b* fixed to the center of the second hub 61*b*, and a second permanent magnet 64*b* fixed to the second hub 61*b*. The other end of the rotating shaft 40' is inserted into the second bearing sleeve 63*b*.

The wind generated by the first blades 62*a* and the second blades 62*b* can be directed outwards by means of the sidewall 12'. The wind can be directed to one direction or to different directions to dissipate the residual heat of heat-generated components.

Possible Effects of Embodiments

In summary, the present invention has beneficial effects as follows. The structure design provided by the present invention, compared with the traditional structure composed of the star-shaped silicon steel sheets and the winding set, reduces the height occupied by the winding set and even reduces the height occupied by the PCB, facilitating the thinning of the fan. The induced magnets can shield the magnetic field of the permanent magnet to prevent other components of the electronic device from being affected The embodiments disclosed above are only the preferred ones of the present invention, which are not to limit the claimed scope of the present invention. Therefore, all the equivalent modifications based on the spirit of the present invention should be covered by the scope of the present invention.

What is claimed is:

1. A thin fan with an axial airgap, comprising:

a base having a bottom plate;

a circuit unit disposed on the bottom plate;

a stator set comprising at least one winding part electrically connected to the circuit unit, multiple induced magnets physically connected to the at least one winding part and being arced-shaped, and at least one winding set correspondingly wound on the at least one winding part; and a rotor set comprising a hub, a plurality of blades disposed on a perimeter of the hub, and a permanent magnet disposed on a perimeter of a bottom side of the hub and correspondingly disposed above the induced magnets, wherein the at least one winding set is located outside of the permanent magnet and is free from being covered by the permanent magnet;

wherein a pivot shaft is disposed between the hub and the bottom plate, wherein the pivot shaft comprises a bearing sleeve and a rotating shaft inserted in the bearing sleeve; and the thin fan further comprises a sleeve seat which comprises a sleeve bottom and a sleeve side portion connected to a perimeter of the sleeve bottom, wherein a sleeve opening is formed on the bottom plate of the base and the sleeve bottom is fixed to the sleeve opening of the base, wherein a bottom end of the rotating shaft is welded and fixed to the center of the sleeve bottom.

2. The thin fan with the axial airgap according to claim 1, wherein a welding hole is formed on the center portion of the sleeve bottom of the sleeve seat, wherein the bottom end of the rotating shaft is welded to the welding hole.

3. The thin fan with the axial airgap according to claim 1, wherein the at least one winding part of the stator set has a straight shape, wherein each of two ends of the at least one winding part is physically connected to a connecting arm which physically connects the corresponding induced magnets arranged in a circle.

4. The thin fan with the axial airgap according to claim 3, wherein the circuit unit comprises a PCB and at least one electronic component disposed on the PCB, wherein the stator set is located on the PCB of the circuit unit, wherein a winding set hole is formed on the PCB to receive part of the at least one winding set.

5. The thin fan with the axial airgap according to claim 4, wherein an opening is formed on the bottom plate of the base corresponding to the winding set hole, wherein the at least one winding set is partially disposed in the opening.

6. The thin fan with the axial airgap according to claim 1, wherein the stator set has two winding parts which are disposed opposite to each other and have straight shapes, wherein each of the two winding parts is wound by the winding set, wherein two ends of the each of the two winding parts are individually physically connected to a connecting arm which physically connects the corresponding induced magnets arranged in a circle.

7. The thin fan with the axial airgap according to claim 6, wherein the circuit unit comprises a PCB and at least one electronic component disposed on the PCB, wherein the stator set is located on the PCB of the circuit unit, wherein two winding set holes are formed on the PCB to correspondingly receive the two winding sets.

8. The thin fan with the axial airgap according to claim 1, wherein the stator set has a plurality of winding parts arranged in a circle, wherein each of the winding parts is wound by the winding set, wherein a connecting arm extends inwards from between each two adjacent winding parts and connects the corresponding induced magnets arranged in a circle.

9. The thin fan with the axial airgap according to claim 8, wherein each of the connecting arms is wound by the winding set.

10. The thin fan with the axial airgap according to claim 1, wherein the circuit unit is disposed outside of the stator set.

11. The thin fan with the axial airgap according to claim 1, further comprising a second rotor set disposed on the other side of the bottom plate, wherein two ends of the rotating shaft individually extend towards two sides of the bottom plate, wherein the second rotor set comprises a second hub, a plurality of second blades disposed on a perimeter of the second hub, a second bearing sleeve fixed to the center of the second hub, and a second permanent magnet fixed to the second hub, wherein the other end of the rotating shaft is inserted into the second bearing sleeve.

* * * * *